US011554458B2

(12) United States Patent
Nakano et al.

(10) Patent No.: US 11,554,458 B2
(45) Date of Patent: Jan. 17, 2023

(54) POLISHING HEAD, WAFER POLISHING APPARATUS USING THE SAME, AND WAFER POLISHING METHOD USING THE SAME

(71) Applicant: SUMCO CORPORATION, Tokyo (JP)

(72) Inventors: Yuki Nakano, Tokyo (JP); Katsuhisa Sugimori, Tokyo (JP); Kazuaki Kozasa, Tokyo (JP); Jiro Kajiwara, Tokyo (JP); Katsutoshi Yamamoto, Tokyo (JP); Takayuki Kihara, Tokyo (JP); Ryoya Terakawa, Tokyo (JP)

(73) Assignee: SUMCO CORPORATION, Tokyo (JP)

( * ) Notice: Subject to any disclaimer, the term of this patent is extended or adjusted under 35 U.S.C. 154(b) by 214 days.

(21) Appl. No.: 17/055,735

(22) PCT Filed: Feb. 13, 2019

(86) PCT No.: PCT/JP2019/004972
§ 371 (c)(1),
(2) Date: Nov. 16, 2020

(87) PCT Pub. No.: WO2019/220712
PCT Pub. Date: Nov. 21, 2019

(65) Prior Publication Data

US 2021/0331285 A1 Oct. 28, 2021

(30) Foreign Application Priority Data

May 17, 2018 (JP) ..... JP2018-095300

(51) Int. Cl.
*B24B 37/32* (2012.01)
*B24B 7/22* (2006.01)
(Continued)

(52) U.S. Cl.
CPC ..... *B24B 37/32* (2013.01); *B24B 7/228* (2013.01); *B24B 37/107* (2013.01); *B24B 57/02* (2013.01)

(58) Field of Classification Search
CPC ..... B24B 37/32; B24B 7/228; B24B 37/107; B24B 57/02
(Continued)

(56) References Cited

U.S. PATENT DOCUMENTS 9,321,144 B2 4/2016 Woo et al.
9,381,613 B2 * 7/2016 Leighton ..... B24B 41/061
(Continued)

FOREIGN PATENT DOCUMENTS

JP 2003-175455 A 6/2003
JP 2003175455 * 6/2003 ..... B24B 37/005
(Continued)

OTHER PUBLICATIONS

Written Opinion of the International Searching Authority in International Patent Application No. PCT/JP2019/004972, dated Apr. 23, 2019, along with an English translation thereof.
(Continued)

*Primary Examiner* — Joseph J Hail
*Assistant Examiner* — Shantese L McDonald
(74) *Attorney, Agent, or Firm* — Greenblum & Bernstein, P.L.C.

(57) ABSTRACT

A polishing head of a wafer polishing apparatus is provided with: a membrane head that can independently control a center control pressure pressing a center portion of a wafer, and an outer periphery control pressure pressing an outer peripheral portion of the wafer; an outer ring integrated with the membrane head so as to configure the outer peripheral portion of the membrane head; and a contact type retainer ring provided outside the membrane head. The membrane
(Continued)

head has a central pressure chamber of a single compartment structure that controls the center control pressure, and an outer peripheral pressure chamber that is provided above the central pressure chamber, and that controls the outer periphery control pressure. A position of a lower end of the outer ring reaches at least a position of an inner bottom surface of the central pressure chamber.

16 Claims, 9 Drawing Sheets

(51) Int. Cl.
*B24B 37/10* (2012.01)
*B24B 57/02* (2006.01)

(58) Field of Classification Search
USPC ..... 451/287, 398, 288
See application file for complete search history.

(56) References Cited

U.S. PATENT DOCUMENTS

2002/0042246 A1 4/2002 Tagawa et al.
2004/0005842 A1* 1/2004 Chen ..... B24B 49/16 451/41
2005/0107015 A1 5/2005 Togawa et al.
2009/0023368 A1 1/2009 Wu et al.
2009/0291623 A1 11/2009 Masumura et al.
2013/0136884 A1 5/2013 Yasuda et al.
2013/0316628 A1* 11/2013 Jang ..... B24B 37/30 451/398
2014/0150974 A1 6/2014 Oh et al.
2014/0242886 A1 8/2014 Woo et al.
2016/0368115 A1* 12/2016 Yasuda ..... B24B 47/12
2017/0106496 A1* 4/2017 Ala ..... B24B 37/32

FOREIGN PATENT DOCUMENTS

JP 2008-110407 A 5/2008
JP 2015-536575 A 12/2015
KR 101293485 * 7/2013 ..... H01L 21/304
KR 10-1293485 B1 8/2013
TW 576773 B 2/2004
TW 200403788 A 3/2004
TW 201341187 A 10/2013
WO 2014/085203 A1 6/2014

OTHER PUBLICATIONS

Office Action issued in Taiwan Patent Appl. No. 108105257 dated Oct. 22, 2019, along with an English translation thereof.
International Search Report in International Patent Application No. PCT/JP2019/004972, dated Apr. 23, 2019, along with an English translation thereof.
Office Action dated Jun. 3, 2022 and issued in Korean Patent Application No. 10-2020-7034082 along with corresponding English translation.

* cited by examiner

POLISHING HEAD, WAFER POLISHING APPARATUS USING THE SAME, AND WAFER POLISHING METHOD USING THE SAME

TECHNICAL FIELD

The present invention relates to a polishing head and a wafer polishing apparatus and method using the same and, more particularly, to a polishing head suitably used for wafer final polishing and a wafer polishing apparatus and method using the same.

BACKGROUND ART

A silicon wafer is widely used as a substrate material for semiconductor devices. The silicon wafer is manufactured by sequentially applying processes such as outer peripheral grinding, slicing, lapping, etching, double-sided polishing, single-sided polishing, cleaning, etc., to a silicon single crystal ingot. Among the above processes, the single-sided polishing is a process required to remove irregularities or waviness of the wafer surface and thus to enhance flatness, in which mirror finishing by CMP (Chemical Mechanical Polishing) method is performed.

Typically, in the single-sided polishing process for a silicon wafer, a single wafer polishing apparatus (CMP apparatus) is used. This wafer polishing apparatus includes a rotary platen on which a polishing cloth is affixed and a polishing head for holding a wafer on the polishing cloth while pressing the wafer. The apparatus rotates the rotary platen and polishing head while supplying slurry to thereby polish one side of the wafer.

With regard to a wafer polishing apparatus, for example, Patent Literature 1 describes a polishing head configured to hold the back surface of a work such as a silicon wafer against the lower surface part of a rubber membrane and to polish the wafer while bringing the front surface of the wafer into sliding contact with a polishing cloth attached to a surface plate. This polishing head is equipped with a ring-shaped rigid ring, a rubber membrane bonded to the rigid ring with a uniform tension, and a ring-shaped template (retainer ring) installed at the periphery of the rubber membrane undersurface concentrically with the rigid ring and having an outer diameter larger than the inner diameter of the rigid ring. The inner diameter of the template is smaller than that of the rigid ring, and the ratio of the inner diameter difference between the rigid ring and the template to the difference between the template inner diameter and outer diameter is 26% or more and 45% or less, so that the inner peripheral portion of the template can be freely deformed, allowing the rubber membrane to uniformly press the entire surface of the work.

Patent Literature 2 describes a wafer polishing apparatus developed for enhancement of wafer flatness. To this end, the apparatus is provided with a multi-zone pressurizing carrier head having a wafer pressing surface divided into a plurality of pressure zones and capable of performing pressurizing control independently for each pressure zone. A flexible membrane of the carrier head includes a main portion, an annular outer portion, and three annular flaps concentrically defining first to third pressure chambers. The carrier head has a recess formed along an outer wall surface of the annular outer portion of the flexible membrane, an outer ring inserted into the recess, and an inner ring formed along an inner wall surface of the annular inner portion of the flexible membrane to thereby reinforce the annular portion of the flexible membrane.

RELATED ART

Patent Literature

[Patent Literature 1] Japanese Patent Application Laid-open No. 2008-110407

[Patent Literature 2] Japanese Patent Application Laid-open No. 2015-536575

SUMMARY OF THE INVENTION

Problems to be Solved by the Invention

In the single-sided polishing process for a silicon wafer, a wafer polishing amount tends to be larger at the outer peripheral portion than the center portion due to stress concentration, inflow of slurry, or other factors. Thus, the control pressure at the wafer center portion and control pressure at the outer peripheral portion are desirably controlled independently of each other.

However, in the conventional polishing head described in Patent Literature 1, the rubber membrane constitutes a single pressure zone, so that the control pressure at the wafer center portion and control pressure at the outer peripheral portion cannot be controlled independently. Further, in a system having a contact type template, as the template gradually wears, pressure distribution on a polishing surface varies, making it difficult to maintain pressure distribution on a wafer polishing surface constant. It follows that the polishing amount at the wafer outer peripheral portion cannot be controlled, failing to obtain a wafer with high flatness.

The conventional wafer polishing apparatus described in Patent Literature 2 can independently control the control pressure at the wafer center portion and control pressure at the outer peripheral portion. However, the outer ring provided at the side surface of the flexible membrane covers only the upper portion of the annular outer portion, so that control pressure cannot sufficiently be transmitted to the wafer outer peripheral portion, resulting in small control width of the control pressure at the outer periphery. Further, the outer and inner rings are not bonded to the flexible membrane but are simply set in an inserted manner. Thus, when the outer or inner ring shifts, waviness is likely to occur in pressure distribution on the back surface of the flexible membrane, making it difficult to enhance wafer flatness.

The object of the present invention is therefore to provide a polishing head capable of achieving high flatness by suppressing waviness of polishing pressure at the wafer outer periphery and a wafer polishing apparatus and method using such a polishing head.

Means for Solving the Problems

To solve the above problems, a polishing head according to the present invention of a wafer polishing apparatus includes a membrane head capable of independently controlling a center control pressure for pressing the center portion of a wafer and an outer periphery control pressure for pressing the outer peripheral portion of the wafer; an outer ring integrally formed with the membrane head so as to constitute the outer peripheral portion of the membrane head; and a contact type retainer ring provided outside the membrane head. The membrane head has a single compartment central pressure chamber configured to control the center control pressure and an outer peripheral pressure chamber provided above the central pressure chamber and configured to control the outer periphery control pressure. A position of a lower end of the outer ring reaches at least a position of an inner bottom surface of the central pressure chamber, and a position of an upper end of the outer ring reaches at least a position of an inner upper surface of the central pressure chamber.

According to the present invention, a polishing pressure against the wafer center portion and a polishing pressure against the wafer outer peripheral portion can be independently controlled. In particular, the outer periphery control pressure can be adjusted in accordance with a change in the thickness of the retainer ring due to wear. Further, since the retainer ring is a contact type, it is possible to suppress excessive polishing of the wafer outer peripheral portion and gradient of polishing surface pressure distribution. Further, the outer ring extends over a wide range from the inner bottom surface of the central pressure chamber of the membrane head to the inner upper surface thereof to support the outer peripheral portion of the membrane head, it is possible to reliably transmit a pressure from the outer peripheral pressure chamber to the wafer outer peripheral portion and thereby to increase the control width of the outer periphery control pressure. Thus, it is possible to suppress waviness of the polishing pressure and generation of an unpressurized area at the wafer outer peripheral portion to thereby make pressure distribution on the wafer polishing surface constant. As a result, wafer flatness can be enhanced.

In the present invention, the membrane head preferably has a circular main surface part constituting a pressing surface against the wafer and an annular side surface part extending upward from the outer peripheral end of the main surface part, and the outer ring is preferably integrally formed with the membrane head during the formation of the membrane head and secured by bonding to the outer peripheral surface of the side surface part. This can prevent a variation in the polishing pressure distribution due to shifting of the outer ring during polishing. Thus, it is possible to make pressure distribution on the wafer polishing surface constant to thereby enhance wafer flatness. Further, the outer ring supports a wide range of the side surface part of the membrane head from the lower end to the upper end, so that deformation of the side surface part of the membrane head can be suppressed to reduce the waviness of pressure distribution on the wafer back surface. Further, the membrane head is integrally formed with the outer ring, thus eliminating the need to perform work for fitting the outer ring to the membrane head that has been processed into a predetermined shape, which in turn can prevent the occurrence of twisting of the membrane head and assembly errors. Thus, it is possible to suppress unintended strain of the membrane head caused by pulling force applied when the membrane head is fitted with the outer ring to make it possible to reliably transmit the outer periphery control pressure.

In the present invention, the membrane head preferably further includes an upper annular flap extending inward in the radial direction from the upper end portion of the side surface part and a lower annular flap extending inward in the radial direction from the intermediate portion of the side surface part below the upper end portion, the central pressure chamber is preferably a closed space surrounded by the main surface part, side surface part, and lower annular flap, the outer peripheral pressure chamber is preferably a closed space surrounded by the lower annular flap, side wall surface part, and upper annular flap, an upper surface of the main surface part preferably constitutes the inner bottom surface of the central pressure chamber, and a bottom surface of the lower annular flap preferably constitutes the inner upper surface of the central pressure chamber. With the above configuration, it is possible to independently control the polishing pressure against the wafer center portion and polishing pressure against the wafer outer peripheral portion to thereby make pressure distribution on the wafer polishing surface constant. Further, the upper and lower annular flaps extend inward in the radial direction of the membrane head, so that it is possible to prevent the outer periphery control pressure from affecting a retainer contact pressure.

In the present invention, corners of the outer ring contacting the membrane head are preferably chamfered, and a recess is preferably formed in the outer peripheral surface of the outer ring that does not contact the membrane head. By chamfering the corners of the outer ring, adhesion between the membrane head and the outer ring can be enhanced. Further, by forming the recess in the outer peripheral surface of the outer ring, the outer ring can be easily attached to a molding die when the membrane head and the outer ring are integrally formed to thereby enhance handling of the outer ring.

The polishing head according to the present invention may further have an inner ring integrally formed with the membrane head during formation of the membrane head and secured by bonding to the inner peripheral surface of the side surface part. With this configuration, the strength of the side surface part of the membrane head can be further enhanced, thereby making it possible to reliably transmit a pressure from the outer peripheral pressure chamber to the wafer outer peripheral portion.

In the present invention, corners of the inner ring contacting the membrane head are preferably chamfered, and a recess is preferably formed in the inner peripheral surface of the inner ring that does not contact the membrane head. By chamfering the corners of the inner ring, adhesion between the membrane head and the inner ring can be enhanced. Further, by forming the recess in the outer inner peripheral surface of the inner ring, the inner ring can be easily attached to a molding die when the membrane head and the inner ring are integrally formed to thereby enhance the handling of the inner ring.

In the present invention, an application area of the center control pressure is preferably a circular area within at least 0.85R (R is the radius of the wafer) from the wafer center, and an application area of the outer periphery control pressure is preferably an annular area outside the application area of the center control pressure.

The polishing head according to the present invention preferably further has a rigid head to which the membrane head and the retainer ring are attached. The rigid head preferably has a through hole connected to a gap between the side surface part of the membrane head and the outer ring and the rigid head, and a cleaning liquid for cleaning the membrane head is preferably supplied into the gap through the through hole. With this configuration, it is possible to remove slurry stuck to the retainer ring during polishing to thereby suppress inconvenience in which coarse particles formed due to peeling off of abrasive grains that have been entered the gap and stuck and agglomerated together may scratch the wafer surface.

Further, according to the present invention, there is provided a wafer polishing apparatus using a polishing head having the above-described feature of the present invention, the apparatus including a rotary platen attached with a polishing cloth, a slurry supply part for supplying slurry onto the rotary platen, and the polishing head for retaining a wafer on the polishing cloth while pressing the wafer. According to the present invention, there can be provided a wafer polishing apparatus capable of uniformly polishing a wafer.

Furthermore, according to the present invention, there is provided a method for polishing one side of a wafer using a wafer polishing apparatus having the above-described feature of the present invention, the method including independently controlling the center control pressure and the outer periphery control pressure so as to make pressure distribution on the wafer polishing surface constant and reducing the outer periphery control pressure as the retainer ring wears. According to the present invention, there can be provided a polishing method capable of uniformly polishing a wafer.

Effects of the Invention

According to the present invention, there can be provided a polishing head capable of achieving a high degree of flatness by suppressing waviness of polishing pressure at the wafer outer peripheral portion and a wafer polishing apparatus and method using such a polishing head.

MODE FOR CARRYING OUT THE INVENTION

Hereinafter, preferred embodiments of the present invention will be described in detail with reference to the accompanying drawings.

Figure 1:
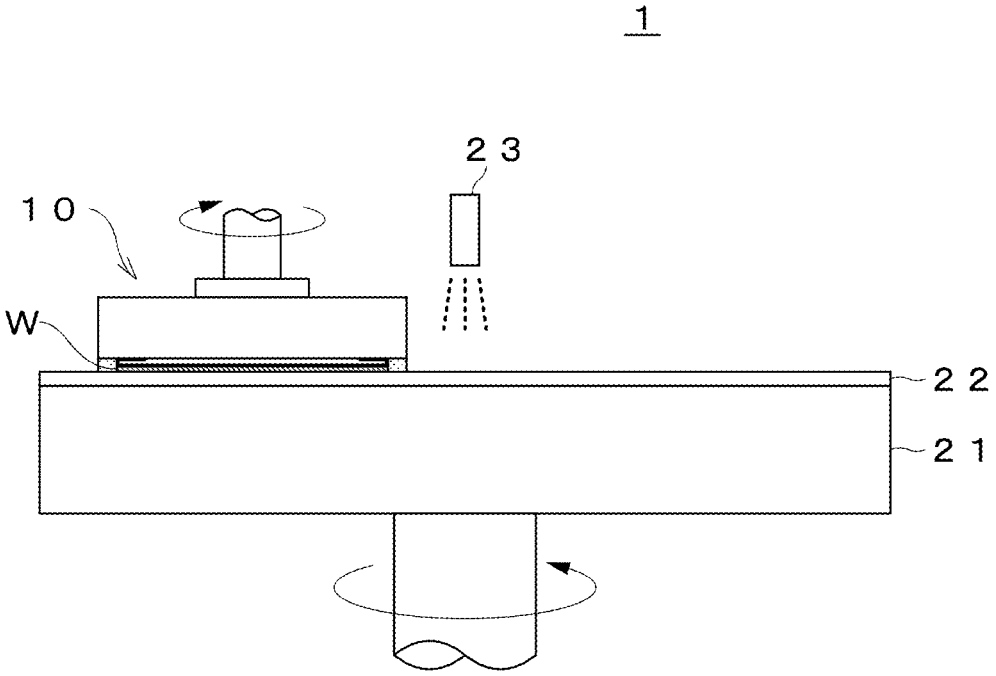
FIG. 1 is a side view schematically illustrating a configuration of a wafer polishing apparatus according to an embodiment of the present invention.

FIG. 1 is a side view schematically illustrating a configuration of a wafer polishing apparatus according to an embodiment of the present invention.

As illustrated in FIG. 1, a wafer polishing apparatus 1 has a rotary platen 21 attached with a polishing cloth 22, a slurry supply part 23 for supplying slurry onto the rotary platen 21, and a polishing head 10 that holds a wafer W placed on the polishing cloth 22 while pressing the wafer W. The main surface of the rotary platen 21 has a planar size sufficiently larger than that of the polishing head 10, and the lower surface (pressing surface) of the polishing head 10 faces the main surface of the rotary platen 21. Although one polishing head 10 is provided on the rotary platen 21 in the present embodiment, a plurality of polishing heads 10 may be provided so as to polish a plurality of wafers W simultaneously. By rotating the rotary platen 21 and the polishing head 10 while supplying slurry onto the polishing cloth 22, one side of the wafer W contacting the polishing cloth 22 can be polished.

Figure 2:
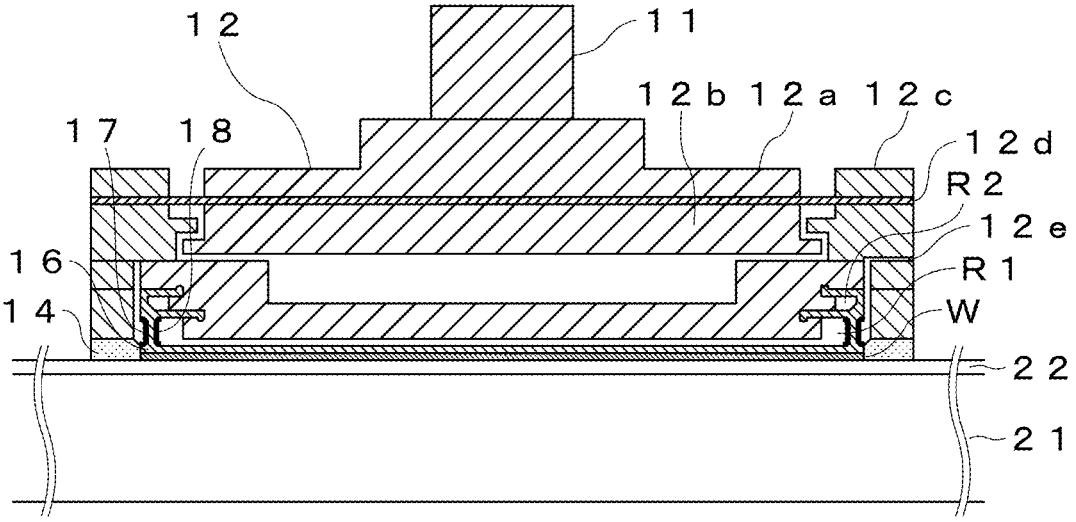
FIG. 2 is a schematic cross-sectional side view illustrating a structure of the polishing head according to a first embodiment.

FIG. 2 is a schematic cross-sectional side view illustrating a structure of the polishing head 10 according to a first embodiment.

As illustrated in FIG. 2, the polishing head 10 has a rotary shaft 11, a rigid head 12 provided to the lower end of the rotary shaft 11, and a contact type retainer ring 14 provided to the bottom surface of the rigid head 12, and a membrane head 16 similarly provided to the bottom surface of the rigid head 12. With this configuration, the polishing head 10 constitutes a wafer pressurizing mechanism that pressurizes the wafer W through the membrane head 16.

The rigid head 12 has a head upper part 12*a* connected to the rotary shaft 11, a head lower part 12*b* connected to the head upper part 12*a* through a drive ring 12*d*, and a head outer peripheral part 12*c*. The head upper part 12*a* is driven into rotation by a spindle mechanism and driven to vertically move by an electric cylinder. The drive ring 12*d* is made of a metal plate spring and transmits the rotational force of the head upper part 12*a* to the head lower part 12*b* and head outer peripheral part 12*c*. The membrane head 16 is secured to the head lower part 12*b*, and the retainer ring 14 is secured to the head outer peripheral part 12*c*.

The retainer ring 14 is a guide member provided at the outer peripheral portion of the bottom surface of the rigid head 12. The retainer ring 14 is configured to be able to press the upper surface of the polishing cloth 22, and the bottom surface of the retainer ring 14 is brought into contact with (grounded to) the polishing cloth 22. The bottom surface of the retainer ring 14 is brought into press contact with the polishing cloth 22, so that horizontal movement of the wafer W can be restricted, thereby making it possible to prevent the wafer from protruding outside the polishing head 10. Further, by contacting the retainer ring 14 to the polishing cloth, it is possible to prevent the gradient of the polishing amount due to the inclination of polishing head 10 and to prevent the wafer outer peripheral portion from being excessively polished by deflection of the polishing cloth.

The bottom surface of the membrane head 16 contacts the entire back surface (upper surface) of the wafer. The membrane head 16 is connected to a not-shown membrane pressurization line, whereby an air pressure is fed inside the membrane head 16. The air pressure is fed inside the membrane head 16 through the membrane pressurization line to expand the membrane head 16, whereby the wafer W is pressed downward. In the membrane head 16, two pressure chambers (central pressure chamber R1 and outer peripheral pressure chamber R2) are formed, and pressure in each pressure chamber is individually controlled by the air pressure fed through the membrane pressurization line provided separately for each pressure chamber. By individually setting the air pressure to be fed to each pressure chamber, an adequate pressing force is applied to the center portion and outer peripheral portion of the wafer W.

The polishing head 10 according to the present embodiment adopts a retainer contacting system and presses the retainer ring 14 against the polishing cloth 22, so that it is possible to prevent the inclination of the polishing head 10 that would occur in a conventional polishing head 10 that does not adopt the retainer contacting system. This can suppress the gradient of the wafer polishing amount distribution. Further, when the retainer ring 14 is not contacted, the polishing cloth 22 outside the wafer W is deflected upward upon sliding movement of the wafer W on the polishing cloth 22 to increase the polishing amount of the corner of the wafer W. However, by using the contact type retainer ring 14, it is possible to prevent concentration of stress on the outer peripheral portion of the wafer W to thereby prevent the corner of the wafer W from being excessively polished.

Figure 3:
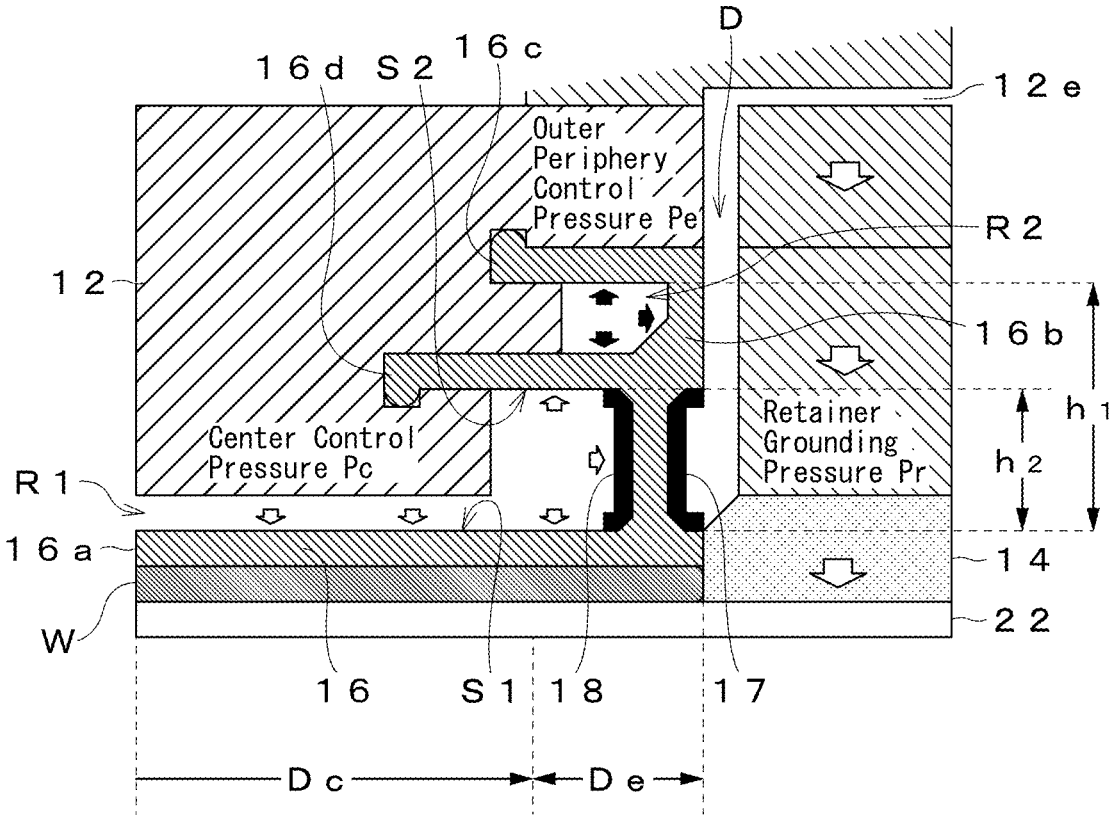
FIG. 3 is a partial cross-sectional view illustrating in detail a structure of the membrane head of FIG. 2.

FIG. 3 is a partial cross-sectional view illustrating in detail a structure of the membrane head 16 of FIG. 2.

As illustrated in FIG. 3, the membrane head 16 is made of a thin rubber material and has a circular main surface part 16*a* constituting a pressing surface against the wafer W, an annular side surface part 16*b* extending upward from the outer peripheral end of the main surface part 16*a*, an upper annular flap 16*c* extending inward in the radial direction from the upper end portion of the side surface part 16*b*, and a lower annular flap 16*d* extending inward in the radial direction from the intermediate portion of the side surface part 16*b* below the upper end of the side surface part 16*b*.

The size of the main surface part 16*a* of the membrane head 16 is substantially the same as the size of the wafer W. Thus, when the diameter of the wafer W is, e.g., 300 mm, the diameter of the main surface part 16*a* is also 300 mm or slightly larger. A height $h_1$ of the side surface part 16*b* is 10 mm to 15 mm, and a height $h_2$ of the intermediate portion connected with the lower annular flap 16*d* can be 0.5 $h_1$ to 0.7 $h_1$ (mm). The lower annular flap 16*d* is larger in length than the upper annular flap 16*c* and, thus, the tip of the lower annular flap 16*d* protrudes inward in the radial direction from the tip of the upper annular flap 16*c*.

As described above, the membrane head 16 has the central pressure chamber R1 having a single compartment structure and controlling a pressure at the center of the wafer W and the outer peripheral pressure chamber R2 provided above the central pressure chamber R1 and controlling a pressure at the outer periphery of the wafer W. The central pressure chamber R1 is a closed space surrounded by the main surface part 16*a* of the membrane head 16, the lower portion of the side surface part 16*b*, the lower annular flap 16*d*, and the rigid head 12. The outer peripheral pressure chamber R2 is a closed space surrounded by the upper annular flap 16*c* of the membrane head 16, the upper portion of the side surface part 16*b*, the lower annular flap 16*d*, and the rigid head 12.

An outer ring 17 and an inner ring 18 are secured respectively to the outer peripheral and inner peripheral surfaces of the side surface part 16*b* of the membrane head 16. The outer ring 17 is a rigid ring bonded to the outer surface (outer peripheral surface) of the side surface part 16*b* of the membrane head 16 and supports the membrane head 16 from the outside thereof. The inner ring 18 is a rigid ring bonded to the inner surface (inner peripheral surface) of the side surface part 16*b* of the membrane head 16 and supports the membrane head 16 from the inside thereof. The outer and inner rings 17 and 18 may be made of SUS. The outer and inner rings 17 and 18 are preferably made of the same material.

When the outer ring 17 is not provided, the side surface part 16*b* of the membrane head 16 can be deflected outward or inward, making it difficult to transmit an outer periphery control pressure Pe to the wafer outer periphery through the side surface part 16*b*. However, when the outer ring 17 is provided, the outer ring 17 serves as a wall suppressing the deflection of the side surface part 16*b* to thereby suppress the deformation of the side surface part 16*b*, thus making it possible to reliably transmit the outer periphery control pressure Pe. Further, by providing the inner ring 18, it is possible to reliably suppress the deformation of the side surface part 16*b*.

In the present embodiment, the membrane head 16 is integrally formed with the outer ring 17 and inner ring 18. The outer diameter of a part (a lower portion) of the side surface part 16*b* of the membrane head 16 that contacts the outer ring 17 coincides with the inner diameter of the outer ring 17, and the inner diameter of a part (a lower portion) of the side surface part 16*b* of the membrane head 16 that contacts the inner ring 18 coincides with the outer diameter of the inner ring 18. Thus, the membrane head 16 is free from tensile stress (strain) due to a difference in dimension from the outer ring 17 or inner ring 18. Further, there is no need to perform work for fitting the outer ring 17 and inner ring 18 to the membrane head 16.

In a conventional structure in which the outer ring 17 and inner ring 18 are fitted to the membrane head 16, in order to enhance adhesion between the outer and inner rings 17 and 18 and the membrane head 16, the outer diameter of the side surface part 16*b* of the membrane head 16 is designed to be slightly larger than the inner diameter of the outer ring 17, and the inner diameter of the side surface part 16*b* of the membrane head 16 is designed to be slightly smaller than the outer diameter of the inner ring 18. This makes it very difficult to fit the outer and inner rings 17 and 18 to the membrane head 16. As a result, it is difficult to closely fit the outer and inner rings 17 and 18 without causing twisting of the membrane, and assembly errors are likely to occur. Further, the outer and inner rings 17 and 18 are not bonded to the membrane head 16, so that the positional relationship between the membrane head 16 and the outer and inner rings 17 and 18 may change during use to easily cause a variation in polishing pressure distribution.

On the other hand, the membrane head 16 according to the present embodiment is integrated with the outer and inner rings 17 and 18 when it is completed by a molding process, so that there is no need to perform fitting work, which needs to be done in the conventional technology, and twisting of the membrane head 16 or assembly errors by no means occurs. Further, the outer and inner rings 17 and 18 are secured by bonding to the membrane head 16, so that it is possible to prevent the outer and inner rings 17 and 18 from shifting during polishing to thereby prevent a variation in the polishing pressure distribution.

Further, the membrane head 16 according to the present embodiment is cooled upon its formation in a state of being bonded to the outer ring 17 and is thus applied with no tension as long as pressure is applied from outside. Thus, even when pressure is applied during polishing, it is possible to suppress unintended strain (strain caused by pulling force applied when the membrane head 16 is fitted with the outer ring 17 in a case where the membrane head 16 is separately formed from the outer ring 17) of the membrane head 16 to make it possible to reliably transmit the outer periphery control pressure.

In the present embodiment, the height position of the lower end of the outer ring 17 is substantially the same as the height position of an inner bottom surface S1 of the central pressure chamber R1, and the height position of the upper end of the outer ring 17 is set equal to or higher than the height position of an inner upper surface S2 of the central pressure chamber R1. That is, the outer ring 17 entirely covers the central pressure chamber R1 in the height direction. Thus, it is possible to suppress deflection of the side surface part 16*b* of the membrane head 16 during pressurization to thereby reliably transmit the outer periphery control pressure Pe to the outer peripheral portion of the wafer W. This makes it possible to reduce waviness of pressure distribution on the wafer back surface. The lower end of the outer ring 17 only needs to reach the position of the inner bottom surface S1 of the central pressure chamber R1 and may be positioned slightly below the inner bottom surface S1. Further, the upper end of the outer ring 17 only needs to reach the position of the inner upper surface S2 of the central pressure chamber R1, and even when the upper end of the outer ring 17 is positioned above the inner upper surface S2, the outer periphery control pressure Pe can be transmitted as long as the upper end of the outer ring 17 is positioned below the outer upper surface of the outer peripheral pressure chamber R2.

The corners of the outer and inner rings 17 and 18 contacting the membrane head 16 are preferably chamfered. Further, a recess is preferably formed in the outer peripheral surface of the outer ring 17 and in the inner peripheral surface of the inner ring 18. By chamfering the corners of the outer and inner rings 17 and 18, adhesion between the membrane head 16 and the outer and inner rings 17 and 18 can be enhanced. Further, by forming the recess in the outer peripheral surface of the outer ring 17 and in the inner peripheral surface of the inner ring 18, the outer and inner rings 17 and 18 can be easily attached to a molding die to enhance the handling of the outer and inner rings 17 and 18.

In the present embodiment, the polishing pressure at the outer peripheral portion of the wafer W is controlled independently of the polishing pressure at the center portion of the wafer W. By changing the outer periphery control pressure Pe in accordance with a variation in the thickness of the outer peripheral portion of the wafer W and a change, due to wear, in the thickness of the retainer ring 14 retaining the side surface of the wafer W, the polishing pressure to the outer peripheral portion of the wafer W can be adjusted.

An application area Dc of a center control pressure Pc is a circular area within at least 0.85R (R is the radius of the wafer W) from the center of the wafer W and, preferably, a circular area within 0.93R from the center of the wafer W. On the other hand, an application area De of the outer periphery control pressure is an annular area outside the application area Dc of the center control pressure, and the annular area preferably ranging from 0.85R to 1R and, more preferably, 0.93R to 1R. In this manner, the polishing pressure at a large part of the wafer W is controlled by the center control pressure Pc, and the polishing pressure at the outer peripheral portion of the wafer W is controlled by the outer periphery control pressure Pe, whereby it is possible to uniformly polish the wafer surface.

In the retainer contacting system, the protruding amount of the main surface part 16*a* of the membrane head 16 in the downward direction from the lower surface of the retainer ring 14 increases as the retainer ring 14 wears, so that pressing force against the wafer W becomes large, with the result that the polishing amount of the wafer W, particularly, the polishing amount of the outer peripheral portion of the wafer W becomes larger than expected. However, by reducing the outer periphery control pressure Pe in accordance with the wear of the retainer ring 14, it is possible to make the polishing amount distribution constant.

In the present embodiment, the lower annular flap 16*d* and upper annular flap 16*c* preferably extend inward in the radial direction. It is possible for the lower annular flap 16*d* and upper annular flap 16*c* to extend outward in the radial direction; however, in this case, when the retainer ring 14 is pressurized from the upper side of the polishing head 10, a retainer contact pressure Pr varies under the influence of the outer periphery control pressure Pe, and the outer periphery control pressure Pe varies under the influence of the retainer contact pressure Pr. On the other hand, when the lower annular flap 16*d* and upper annular flap 16*c* extend inward in the radial direction, it is possible to prevent one of the outer periphery control pressure Pe and retainer contact pressure Pr from having influence on the other one of them.

Further, when the lower annular flap 16*d* and upper annular flap 16*c* extend inward in the radial direction, it is possible to increase a gap D between the side surface part 16*b* of the membrane head 16 and a part of the rigid head 12 above the retainer ring 14 as much as possible. In this case, the rigid head 12 preferably has a through hole 12*e* connected to the gap D between the side surface part 16*b* of the membrane head 16 and outer ring 17, and the rigid head 12, and a cleaning liquid for cleaning the membrane head 16 is preferably supplied into the gap D through the through hole 12*e*. As the polishing continues, slurry sticks to the surface of the retainer ring 14, so that cleaning needs to be performed to remove the slurry. In the present embodiment, cleaning water is injected into the gap D between the side surface part 16*b* of the membrane head 16 and the rigid head 12 to clean the retainer ring 14, whereby the slurry can be removed. Thus, it is possible to suppress inconvenience in which coarse particles formed due to peeling off of abrasive grains that have been entered the gap D, stuck, and agglomerated together may scratch the wafer surface.

As described above, the wafer polishing apparatus 1 according to the present embodiment has a two-zone membrane head with a contact type retainer capable of independently pressurizing the center portion of the wafer W and outer peripheral portion thereof. The outer ring 17 retaining the side surface part 16*b* of the membrane head 16 supports a wide area from the lower end of the side surface part 16*b* to the upper end thereof, thus making it possible to increase the control width of the outer periphery control pressure by suppressing deformation of the side surface part 16*b* of the membrane head 16 during pressurization. Thus, it is possible to reduce waviness of the polishing pressure at the wafer outer peripheral portion to thereby enhance the flatness of the wafer polishing surface. Further, the outer and inner rings 17 and 18 are integrally formed with the membrane head 16 during formation of the membrane head 16, thus eliminating the need to perform work for fitting the outer and inner rings 17 and 18 to the membrane head 16, which in turn can prevent the occurrence of assembly errors or a variation in the pressure distribution on the wafer back surface due to shifting of the outer and inner rings 17 and 18 during polishing.

Figure 4:
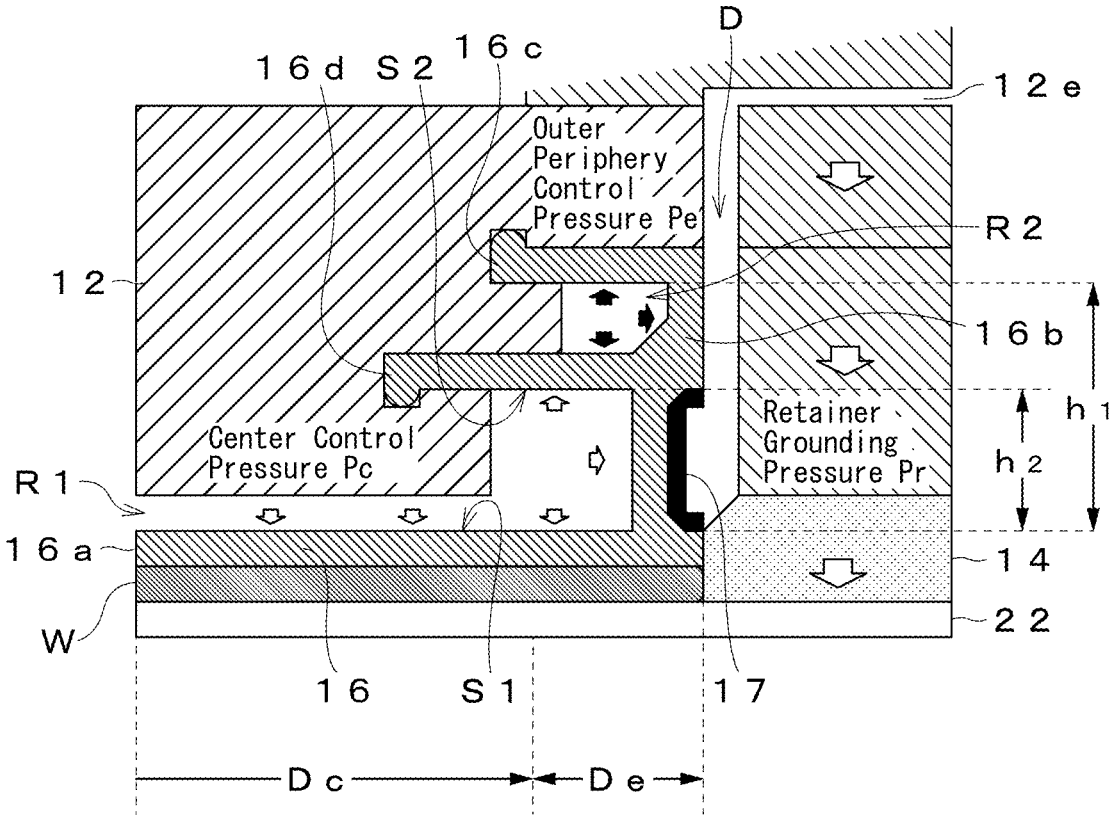
FIG. 4 is a partial cross-sectional view illustrating in detail a structure of the membrane head of the polishing head according to a second embodiment.

FIG. 4 is a partial cross-sectional view illustrating in detail a structure of the membrane head 16 of the polishing head 10 according to a second embodiment.

As illustrated in FIG. 4, the polishing head 10 according to the present embodiment is featured in that the inner ring 18 (see FIG. 3) is omitted. Other configurations are the same as those of the polishing head 10 according to the first embodiment. When the side surface part 16*b* of the membrane head 16 is supported by only the outer ring 17, retaining force for the side surface part 16*b* of the membrane head 16 is reduced; however, the strain of the outer peripheral portion of the membrane head 16 caused by correcting the deformation of the side surface part 16*b* of the membrane head 16 can be reduced. This can suppress a variation in the back surface pressure distribution at the wafer outer peripheral portion.

While the preferred embodiments of the present invention have been described, the present invention is not limited to the above embodiments, and various modifications may be made within the scope of the present invention, and all such modifications are included in the present invention.

For example, although the outer and inner rings 17 and 18 are bonded to the side surface part 16*b* of the membrane head 16 in the above embodiments, it is possible to omit the side surface part 16*b* itself. In this case, the main surface part 16*a* of the membrane head 16 for applying the center control pressure Pc and the upper and lower annular flaps 16*c* and 16*d* of the membrane head 16 for applying the outer periphery control pressure Pe are constituted by separate membrane members. That is, a membrane member for generating the center control pressure Pc and a membrane member for generating the outer periphery pressure Pe are connected together through a rigid ring.

Examples

<Considerations about Influence of Outer Periphery Control Pressure on Polishing Surface Pressure Distribution>

The pressure distribution of the polishing head according to the present invention against the polishing surface was evaluated by simulation. The object to be polished was a silicon wafer having a diameter of 300 mm, the thickness of the retainer ring was set to 5 mm, the center control pressure Pc was set to 15 kPa, and the change range of the outer periphery control pressure Pe was set to 0 kPa to 40 kPa. The results are shown in FIGS. 5A and 5B.

Figure 5A:
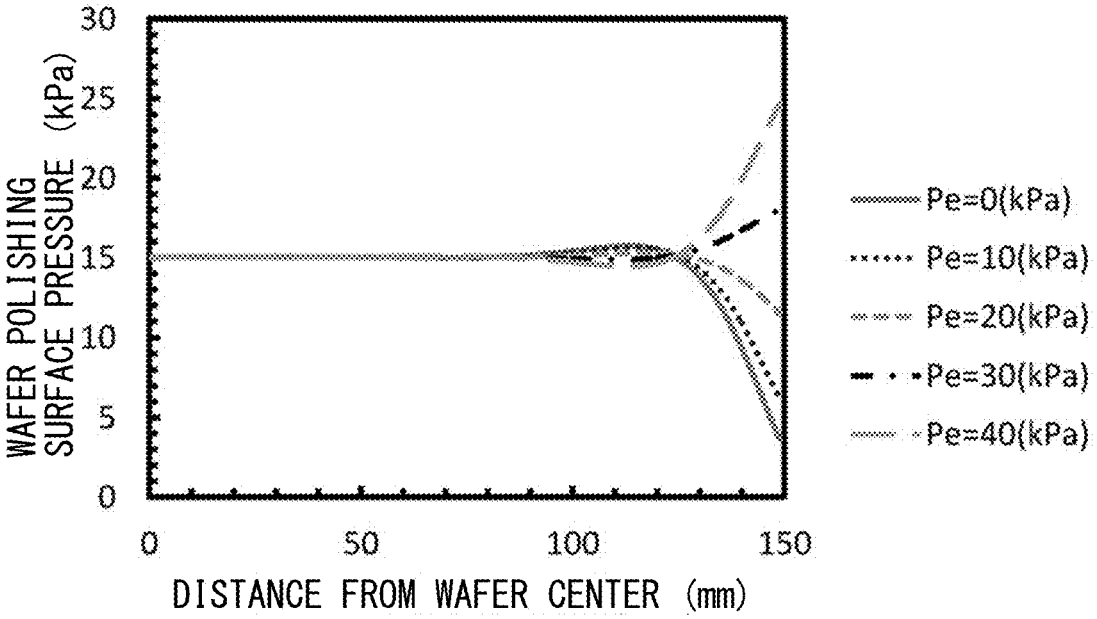
FIGS. 5A and 5B are graphs illustrating pressure distribution on a wafer polishing surface.
Figure 5B:
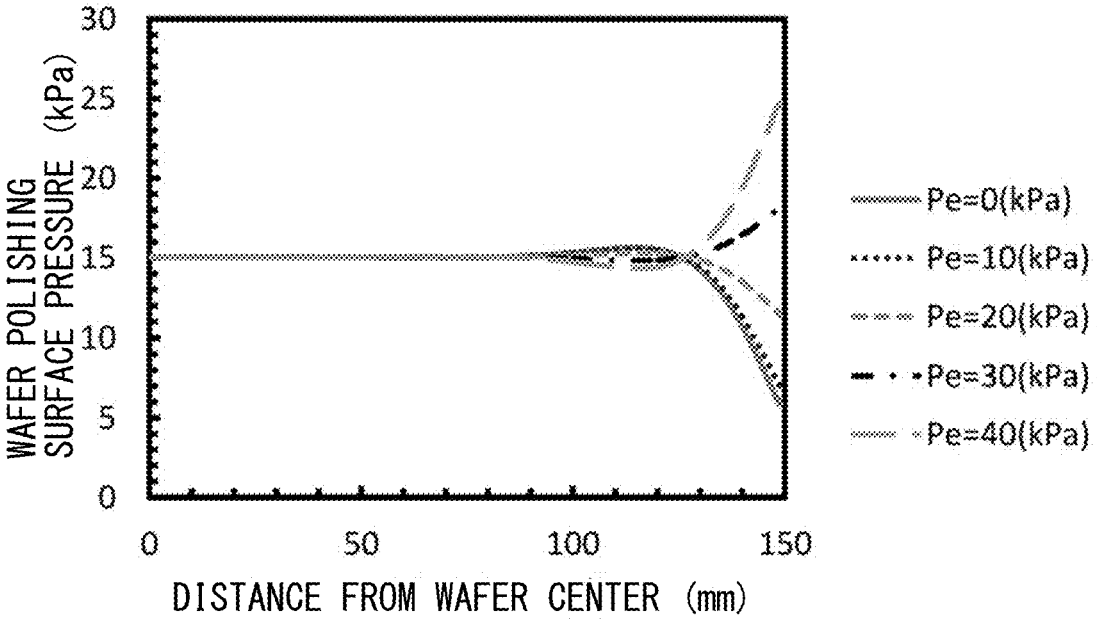

FIGS. 5A and 5B are graphs illustrating pressure distribution on a wafer polishing surface. FIG. 5A illustrates a case where an inner and outer ring-integrated head shape (see FIG. 3) is used, and FIG. 5B illustrates a case where an outer ring-integrated type head shape (see FIG. 4) is used. In the graphs of FIGS. 5A and 5B, the horizontal axis represents the distance (mm) from the wafer center, and the vertical axis represents the wafer polishing surface pressure (kPa).

As is clear from FIGS. 5A and 5B, the wafer polishing surface pressure at the center portion within a radius of 120 mm or less (0 mm to 120 mm) from the wafer center is about 15 kPa which is substantially the same as the center control pressure Pc. On the other hand, the polishing pressure at the outer peripheral portion outside a radius of 120 mm or more (120 mm to 150 mm) from the wafer center increases with increasing outer periphery control pressure Pe and changes in a wide range of 15±10 kPa. This reveals that the wafer polishing surface pressure distribution can be made substantially constant by setting the outer periphery control pressure Pe to about 25 kPa. Thus, it is found that, according to the two-zone membrane with the contact type retainer of the present invention, the polishing surface pressure at the wafer center portion and the polishing surface pressure at the wafer outer peripheral portion can be independently controlled and that the shape of the wafer polishing surface can be controlled by controlling the outer periphery control pressure Pe.

<Considerations about Influence of Thickness of Retainer Ring on Polishing Surface Pressure>

The polishing surface pressure at the outermost peripheral portion positioned at a radius of 149 mm from the wafer center was evaluated by simulation where the polishing head according to the present invention was used to perform wafer polishing. The results are shown in FIGS. 6A and 6B.

Figure 6A:
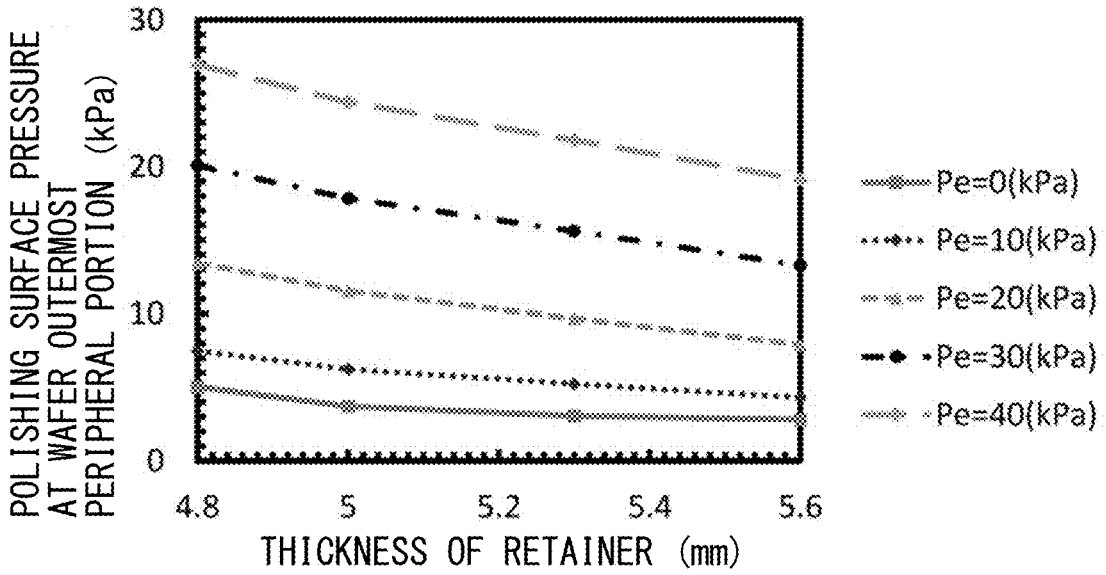
FIGS. 6A and 6B are graphs illustrating a relationship between the thickness of the retainer ring and the polishing surface pressure at the wafer outermost peripheral portion.
Figure 6B:
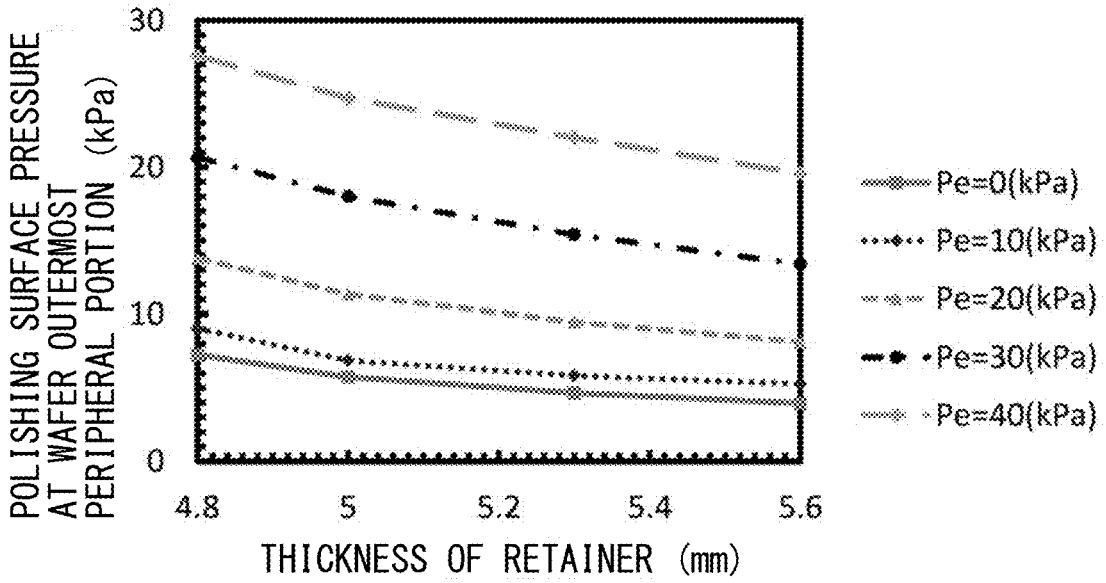

FIGS. 6A and 6B are graphs illustrating a relationship between the thickness of the retainer ring and the polishing surface pressure at the wafer outermost peripheral portion. FIG. 6A illustrates a case where an inner and outer ring-integrated head shape (see FIG. 3) is used, and FIG. 6B illustrates a case where an outer ring-integrated type head shape (see FIG. 4) is used. In the graphs of FIGS. 6A and 6B, the horizontal axis represents the thickness (mm) of the retainer ring, and the vertical axis represents the polishing surface pressure (kPa) at the wafer outermost peripheral portion.

As is clear from FIGS. 6A and 6B, the polishing surface pressure at the wafer outermost peripheral portion increases as the thickness of the retainer ring decreases, and the larger the outer periphery control pressure Pe is, the larger the increasing rate of the polishing surface pressure at the wafer outermost peripheral portion becomes. The thickness of the retainer ring gradually decreases due to wear and, thus, the polishing surface pressure at the wafer outermost peripheral portion gradually increases; however, a gradual reduction in the outer periphery control pressure Pe allows suppression of an increase in the polishing surface pressure at the wafer outermost peripheral portion, whereby the polishing surface pressure at the wafer outermost peripheral portion can be maintained constant.

The wafer polishing surface pressure distribution obtained when the outer periphery control pressure Pe was adjusted so as to maintain the pressure on the entire wafer polishing surface constant (at 15 kPa) on the assumption that the thickness of the retainer ring decreases from 5.6 mm to 5.0 mm and the wafer polishing surface pressure distribution obtained when such adjustment was not made are shown below. Further, the wafer polishing surface pressure distribution before wear of the retainer ring is also shown.

Figure 7:
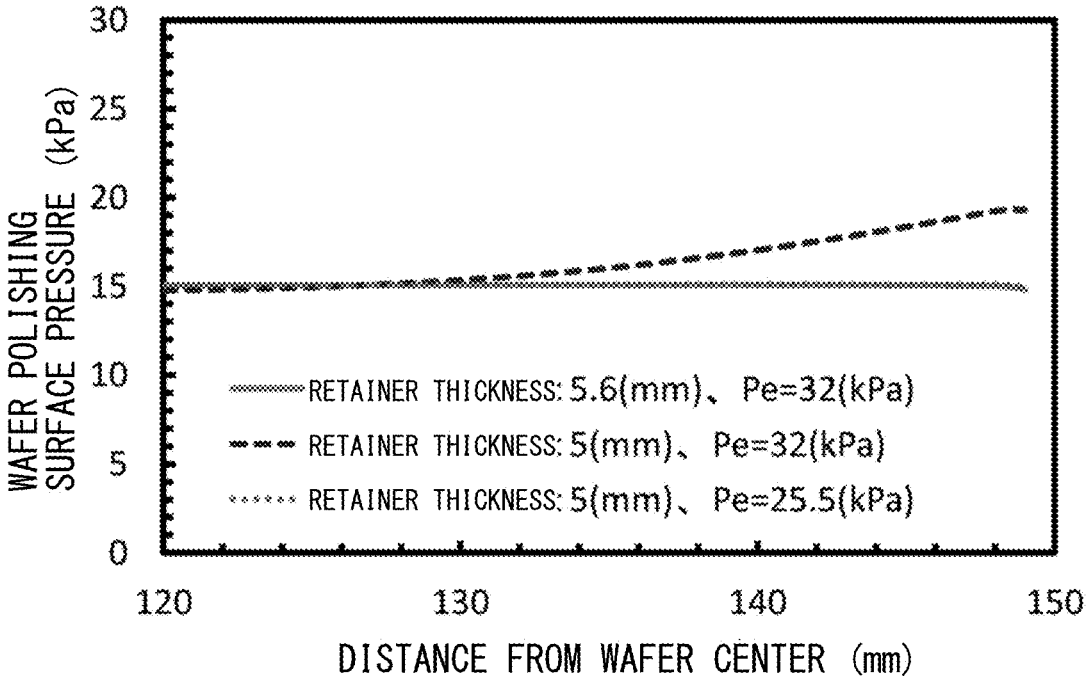
FIG. 7 is a graph illustrating a relationship between the thickness of the retainer ring and the polishing surface pressure distribution of the wafer.

FIG. 7 is a graph illustrating a relationship between the thickness of the retainer ring and the polishing surface pressure distribution of the wafer. In the graph of FIG. 7, the horizontal axis represents the distance (mm) from the wafer center, and the vertical axis represents the wafer polishing surface pressure (kPa).

As illustrated in FIG. 7, when the thickness of the retainer ring is 5.6 mm, and the outer periphery control pressure Pe is 32 kPa, the in-plane distribution of the wafer polishing surface pressure is substantially constant (about 15 kPa). Thereafter, when the thickness of the retainer ring decreases to 5.0 mm due to wear while the outer periphery control pressure Pe is not changed and maintained at 32 kPa, the polishing surface pressure at the wafer outer peripheral portion increases up to about 19 kPa. On the other hand, when the outer periphery control pressure Pe is reduced to 25. 5 kPa, the polishing surface pressure at the wafer outer peripheral portion does not increase, and the in-plane distribution of the polishing surface pressure is maintained substantially constant. Thus, it is confirmed that the wafer polishing surface pressure can be adjusted by changing the outer periphery control pressure Pe.

<Evaluation on Wafer Back Surface Pressure Distribution>

Next, a change in the pressure distribution of the membrane head against the wafer back surface when the center control pressure Pc was set to 15 kPa, and the outer periphery control pressure Pe was changed in the range of 0 kPa to 40 kPa was evaluated by simulation using an example and a comparative example. As the membrane head of example, a two-zone membrane head with a contact type retainer illustrated in FIGS. 2 and 3 was used, and the thickness of the retainer ring was set to 5.0 mm. As the membrane head of comparative example, a two-zone membrane head with a non-contact type retainer was used, in which the outer ring retained only the upper half of the side surface part of the membrane.

Figure 8A:
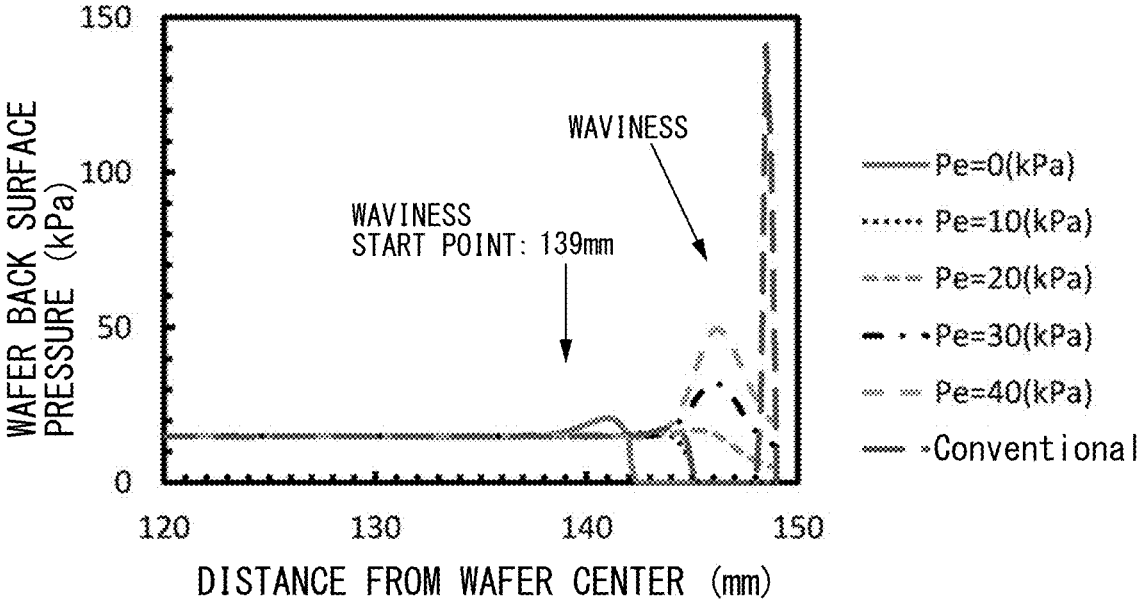
FIGS. 8A and 8B are graphs illustrating a wafer back surface pressure distribution.
Figure 8B:
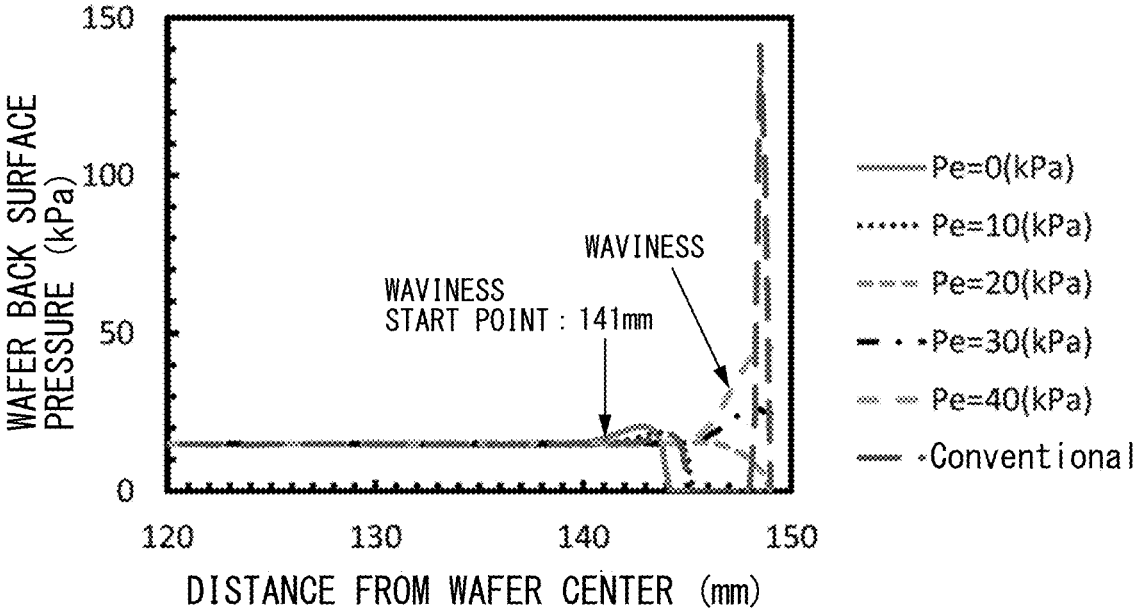

FIGS. 8A and 8B are graphs illustrating a wafer back surface pressure distribution. FIG. 8A illustrates a case where an inner and outer ring-integrated head shape (see FIG. 3) is used, and FIG. 8B illustrates a case where an outer ring-integrated type head shape (see FIG. 4) is used. In the graphs of FIGS. 8A and 8B, the horizontal axis represents the distance (mm) from the wafer center, and the vertical axis represents the wafer back surface pressure (kPa).

As illustrated in FIGS. 8A and 8B, in the conventional membrane head according to Comparative Example, pressure is constant in the area within a radius of 142 mm from the center, while pressure becomes extremely high at the outermost peripheral portion positioned at a radius of 148 mm to 149 mm from the wafer center. On the other hand, in the membrane head according to Example, such an extreme increase in the pressure does not occur. Further, an unpressurized area occurs in the range of 141 mm to 149 mm in radius from the wafer center when the outer periphery control pressure Pe is equal to or less than 10 kPa; however, the unpressurized area does not occur when the Pe is equal to more than 20 kPa. Thus, it is found that by changing the outer periphery control pressure Pe, it is possible to eliminate the unpressurized area at the wafer outer peripheral portion and to control the magnitude of the waviness of the back surface pressure distribution occurring at the wafer outer peripheral portion.

Further, as can be seen from the comparison between the results illustrated in FIGS. 8A and 8B, the peak of the waviness of the back surface pressure is closer to the wafer center when the inner and outer ring-integrated head shape (see FIG. 3) of FIG. 8A is used than when the outer ring-integrated head shape (see FIG. 4) of FIG. 8B is used.

Figure 9A:
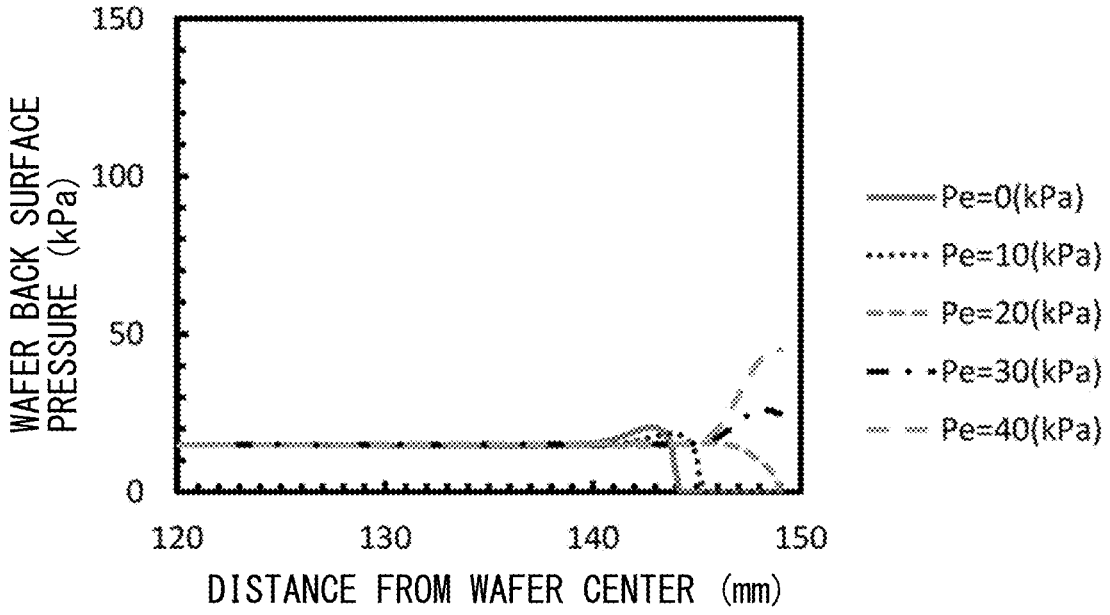
FIGS. 9A and 9B are graphs illustrating a wafer back surface pressure distribution when the polishing head with outer ring-integrated head shape (see FIG. 4) is used.
Figure 9B:
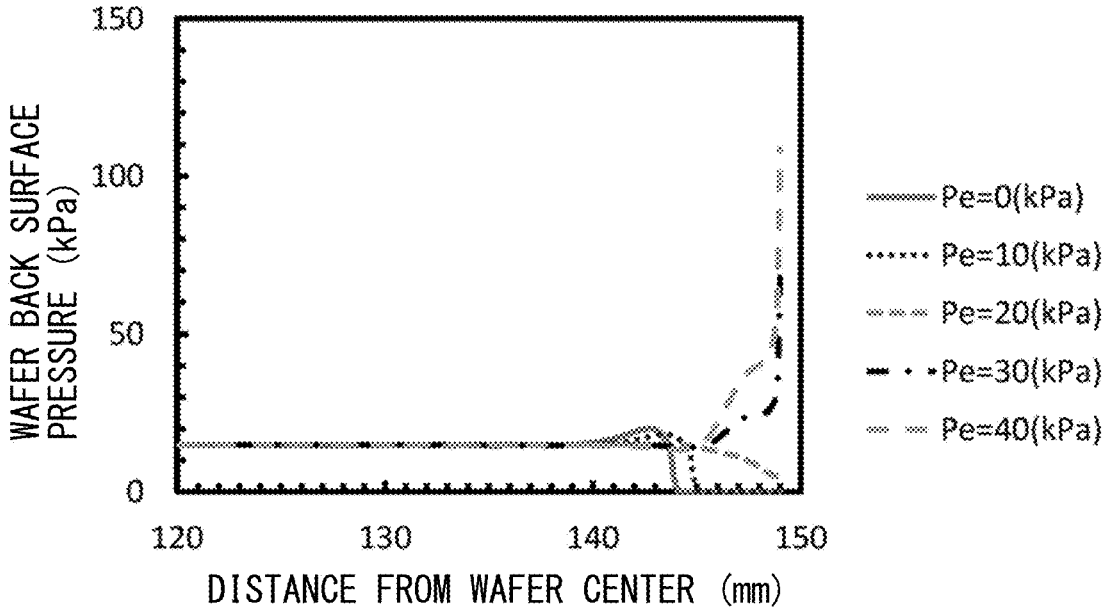

FIGS. 9A and 9B are graphs illustrating the wafer back surface pressure distribution when the polishing head with outer ring-integrated head shape (see FIG. 4) is used. FIG. 9A illustrates a case (like FIG. 4) where the outer ring has a vertical length long enough to cover the entire surface of the side surface part of the membrane head, and FIG. 9B illustrates a case where the outer ring has a short vertical length and thus covers only the upper half of the side surface part of the membrane head. In the graphs of FIGS. 9A and 9B, the horizontal axis represents the distance (mm) from the wafer center, and the vertical axis represents the wafer back surface pressure (kPa).

As illustrated in FIG. 9B, when the vertical length of the outer ring is short, the extreme value/inflection point and the peak of waviness of the wafer back surface pressure become high. On the other hand, as illustrated in FIG. 9A, when the vertical length of the outer ring is long, the extreme value/inflection point and the peak of waviness of the wafer back surface pressure become low. Thus, it is confirmed that the wider the retaining range of the side surface part of the membrane head by the outer ring, the more the deformation of the body and bottom surface of the membrane head is suppressed.

DESCRIPTION OF REFERENCE NUMERALS

1 Wafer polishing apparatus
10 Polishing head
11 Rotary shaft
12 Rigid head
12*a* Head upper part
12*b* Head lower part
12*c* Head outer peripheral part
12*d* Drive ring
12*e* Through hole (cleaning hole)
14 Retainer ring
16 Membrane head
16*a* Main surface part of membrane head
16*b* Side surface part of membrane head
16*c* Upper annular flap of membrane head
16*d* Lower annular flap of membrane head
17 Outer ring
18 Inner ring
21 Rotary platen
22 Polishing cloth
23 Slurry supply part
D Gap
Dc Center control pressure application area
De Outer periphery control pressure application area
Pc Center control pressure
Pe Outer periphery control pressure
Pr Retainer contact pressure
R1 Central pressure chamber
R2 Outer peripheral pressure chamber
S1 Inner bottom surface of central pressure chamber
S2 Inner upper surface of central pressure chamber
W Wafer

The invention claimed is:

1. A polishing head of a wafer polishing apparatus for polishing one side of a wafer, comprising:

a membrane head capable of independently controlling a center control pressure for pressing the center portion of a wafer and an outer periphery control pressure for pressing the outer peripheral portion of the wafer;

an outer ring integrally formed with the membrane head so as to constitute the outer peripheral portion of the membrane head; and a contact type retainer ring provided outside the membrane head, wherein the membrane head has:

a single compartment central pressure chamber configured to control the center control pressure; and an outer peripheral pressure chamber provided above the central pressure chamber and configured to control the outer periphery control pressure, a position of a lower end of the outer ring reaches at least a position of an inner bottom surface of the central pressure chamber, and a position of an upper end of the outer ring reaches at least a position of an inner upper surface of the central pressure chamber, wherein the membrane head has a circular main surface part constituting a pressing surface against the wafer and an annular side surface part extending upward from the outer peripheral end of the main surface part, the outer ring is integrally formed with the membrane head during formation of the membrane head and secured by bonding to an outer peripheral surface of the side surface part, corners of the outer ring contacting the membrane head are chamfered, and a recess is formed in an outer peripheral surface of the outer ring that does not contact the membrane head.

2. The polishing head according to claim 1, wherein the membrane head further includes:

an upper annular flap extending inward in the radial direction from an upper end portion of the side surface part, and a lower annular flap extending inward in the radial direction from an intermediate portion of the side surface part below the upper end portion, the central pressure chamber is a closed space surrounded by the main surface part, the side surface part, and the lower annular flap, the outer peripheral pressure chamber is a closed space surrounded by the lower annular flap, the side surface part, and the upper annular flap, an upper surface of the main surface part constitutes the inner bottom surface of the central pressure chamber, and a bottom surface of the lower annular flap constitutes the inner upper surface of the central pressure chamber.

3. The polishing head according to claim 1 further comprising an inner ring integrally formed with the membrane head during the formation of the membrane head and secured by bonding to an inner peripheral surface of the side surface part.

4. The polishing head according to claim 3, wherein corners of the inner ring contacting the membrane head are preferably chamfered, and a recess is formed in the inner peripheral surface of the inner ring that does not contact the membrane head.

5. The polishing head according to claim 1, wherein an application area of the center control pressure is a circular area within at least 0.85R (R is the radius of the wafer) from the wafer center, and an application area of the outer periphery control pressure is an annular area outside the application area of the center control pressure.

6. The polishing head according to claim 1 further comprising a rigid head to which the membrane head and the retainer ring are attached, wherein the rigid head has a through hole connected to a gap between the side surface part of the membrane head and the outer ring and the rigid head, and a cleaning liquid for cleaning the membrane head is supplied into the gap through the through hole.

7. A wafer polishing apparatus comprising:

a rotary platen attached with a polishing cloth;

a slurry supply part for supplying slurry onto the rotary platen; and the polishing head for retaining a wafer on the polishing cloth while pressing the wafer, wherein the polishing head includes:

a membrane head capable of independently controlling a center control pressure for pressing the center portion of a wafer and an outer periphery control pressure for pressing the outer peripheral portion of the wafer;

an outer ring integrally formed with the membrane head so as to constitute the outer peripheral portion of the membrane head; and a contact type retainer ring provided outside the membrane head, wherein the membrane head has:

a single compartment central pressure chamber configured to control the center control pressure; and an outer peripheral pressure chamber provided above the central pressure chamber and configured to control the outer periphery control pressure, a position of a lower end of the outer ring reaches at least a position of an inner bottom surface of the central pressure chamber, and a position of an upper end of the outer ring reaches at least a position of an inner upper surface of the central pressure chamber, and wherein the membrane head has a circular main surface part constituting a pressing surface against the wafer and an annular side surface part extending upward from the outer peripheral end of the main surface part, the outer ring is integrally formed with the membrane head during formation of the membrane head and secured by bonding to an outer peripheral surface of the side surface part, corners of the outer ring contacting the membrane head are chamfered, and a recess is formed in an outer peripheral surface of the outer ring that does not contact the membrane head.

8. The wafer polishing apparatus according to claim 7, wherein the membrane head further includes:

an upper annular flap extending inward in the radial direction from an upper end portion of the side surface part, and a lower annular flap extending inward in the radial direction from an intermediate portion of the side surface part below the upper end portion, the central pressure chamber is a closed space surrounded by the main surface part, the side surface part, and the lower annular flap, the outer peripheral pressure chamber is a closed space surrounded by the lower annular flap, the side surface part, and the upper annular flap, an upper surface of the main surface part constitutes the inner bottom surface of the central pressure chamber, and a bottom surface of the lower annular flap constitutes the inner upper surface of the central pressure chamber.

9. The wafer polishing apparatus according to claim 7, wherein the polishing head further includes an inner ring integrally formed with the membrane head during the formation of the membrane head and secured by bonding to an inner peripheral surface of the side surface part.

10. The wafer polishing apparatus according to claim 9, wherein corners of the inner ring contacting the membrane head are chamfered, and a recess is formed in the inner peripheral surface of the inner ring that does not contact the membrane head.

11. The wafer polishing apparatus according to claim 7, wherein an application area of the center control pressure is a circular area within at least 0.85R (R is the radius of the wafer) from the wafer center, and an application area of the outer periphery control pressure is an annular area outside the application area of the center control pressure.

12. The wafer polishing apparatus according to claim 7 further comprising a rigid head to which the membrane head and the retainer ring are attached, wherein the rigid head has a through hole connected to a gap between the side surface part of the membrane head and the outer ring and the rigid head, and a cleaning liquid for cleaning the membrane head is supplied into the gap through the through hole.

13. A method for polishing one side of a wafer using a wafer polishing apparatus, the wafer polishing apparatus including:

a rotary platen attached with a polishing cloth;

a slurry supply part for supplying slurry onto the rotary platen; and the polishing head for retaining a wafer on the polishing cloth while pressing the wafer, wherein the polishing head includes:

a membrane head capable of independently controlling a center control pressure for pressing the center portion of a wafer and an outer periphery control pressure for pressing the outer peripheral portion of the wafer;

an outer ring integrally formed with the membrane head so as to constitute the outer peripheral portion of the membrane head; and a contact type retainer ring provided outside the membrane head, wherein the membrane head has:

a single compartment central pressure chamber configured to control the center control pressure; and an outer peripheral pressure chamber provided above the central pressure chamber and configured to control the outer periphery control pressure, a position of a lower end of the outer ring reaches at least a position of an inner bottom surface of the central pressure chamber, and a position of an upper end of the outer ring reaches at least a position of an inner upper surface of the central pressure chamber, and wherein the membrane head has a circular main surface part constituting a pressing surface against the wafer and an annular side surface part extending upward from the outer peripheral end of the main surface part, the outer ring is integrally formed with the membrane head during formation of the membrane head and secured by bonding to an outer peripheral surface of the side surface part, corners of the outer ring contacting the membrane head are chamfered, and a recess is formed in an outer peripheral surface of the outer ring that does not contact the membrane head, the method comprising:

independently controlling the center control pressure and the outer periphery control pressure so as to make pressure distribution on a wafer polishing surface constant; and reducing the outer periphery control pressure as the retainer ring wears.

14. The method according claim 13, wherein the polishing head further includes an inner ring integrally formed with the membrane head during the formation of the membrane head and secured by bonding to an inner peripheral surface of the side surface part, corners of the inner ring contacting the membrane head are chamfered, and a recess is formed in the inner peripheral surface of the inner ring that does not contact the membrane head.

15. A method for polishing one side of a wafer using a wafer polishing apparatus, the method comprising:

preparing an outer ring having chamfered inner corners and a recess in an outer peripheral surface thereof;

integrally forming the outer ring with a membrane head during a formation of the membrane head, the membrane head having a circular main surface part constituting a pressing surface against the wafer and an annular side surface part extending upward from an outer peripheral end of the main surface part, and the outer ring being secured by bonding to an outer peripheral surface of the side surface part;

attaching the membrane head and a contact type retainer ring provided outside the membrane head to a rigid head of a polishing head of the wafer polishing apparatus;

setting a wafer on a rotary platen attached with a polishing cloth;

retaining and pressing the wafer with the polishing head while providing slurry and rotating the rotary platen and the polishing head;

independently controlling a center control pressure and an outer periphery control pressure of the membrane head so as to make pressure distribution on a wafer polishing surface constant; and reducing the outer periphery control pressure as the retainer ring wears.

16. The method according to claim 15 further comprising preparing an inner ring together with the outer ring, the inner ring having chamfered outer corners and a recess in an inner peripheral surface thereof; and integrally forming the inner ring with the membrane head during the formation of the membrane head, the inner ring being secured by bonding to an inner peripheral surface of the side surface part.

* * * * *